United States Patent [19]

Konstantin

[11] Patent Number: 4,649,697

[45] Date of Patent: Mar. 17, 1987

[54] BANDING APPARATUS WITH TILTING BAND POSITIONER

[76] Inventor: Anatole E. Konstantin, 10 Live Oak Rd., Norwalk, Conn. 06851

[21] Appl. No.: 712,972

[22] Filed: Mar. 18, 1985

[51] Int. Cl.[4] ..... B65B 11/00

[52] U.S. Cl. ..... 53/585; 53/291; 53/296

[58] Field of Search ..... 53/128, 139.3, 287, 53/290, 291, 296, 410, 557, 567, 585, 595, 293, 313, 64, 315; 29/775

[56] References Cited

U.S. PATENT DOCUMENTS

| | | | |
|---|---|---|---|
| 1,971,576 | 8/1934 | Nelson | 29/775 |
| 2,815,627 | 12/1957 | Eddison | 53/291 |
| 3,340,591 | 9/1967 | Fisher et al. | 53/410 X |
| 3,374,605 | 3/1968 | Satchwell et al. | 53/128 X |
| 3,415,034 | 12/1968 | Schmitt | 53/128 |
| 4,149,357 | 4/1979 | Lucke | 53/585 |
| 4,215,460 | 8/1980 | Amberg et al. | 29/775 X |
| 4,318,685 | 3/1982 | Konstantin | 53/137 X |
| 4,562,684 | 1/1986 | Dreher | 53/64 |

*Primary Examiner*—John Sipos
*Assistant Examiner*—Steven P. Weihrouch

[57] ABSTRACT

A banding machine is made capable of dependable, high-speed operation by being provided with a rotatably mounted, driven, "C" shaped arm which holds each opened band in a tilted position for being picked up by the article to be banded as it is conveyed past the banding station.

2 Claims, 5 Drawing Figures

BANDING APPARATUS WITH TILTING BAND POSITIONER

TECHNICAL FIELD

This invention relates to apparatus for placing bands of heat-shrinkable, plastic film over articles to be banded.

BACKGROUND OF THE INVENTION

The use of plastic banding is well known for sealing containers of medicine, foodstuff, drink, toiletries and similar products to make them tamper-proof or tamper-evident. Heat-shrinkable bands may also be used for purposes of labeling containers, and for packaging purposes for example to fasten several articles together. A machine suitable for such banding purpose is shown in my U.S. Pat. No. 3,924,387 issued on Dec. 9, 1975, the entire disclosure of which is incorporated herein by reference. Other patents which disclose methods and apparatus for banding are my U.S. Pat. Nos. 4,318,685 and 3,974,628. The banding machines disclosed in such patents while useful, are not capable of operating at rates as high as desired by high speed commercial product packagers.

In an efficient packaging operation it is essential that the banding apparatus be capable of keeping up with the speed or rate at which the containers are being filled, and are hence ready for sealing or labeling. This makes it desirable to have apparatus which is capable of banding containers at rates as high as 600 containers per minute. Moreover, it is desirable to use film which is as thin and as short as possible in order to minimize the cost of the banding material. Since the containers are normally moved to the banding station, and from there to a heating tunnel for shrinking the band by a continuously moving conveyor, the containers could move continuously, were the banding operation not intermittent. That is, prior art machines must stop the container at the banding station for a sufficiently long time to enable the machine to place a band over the container by the stationery band placement mechanism. Although designing a moving banding mechanism, i.e. one that moves along the conveyor with the container, is technically feasable, it would have to be complex and hence costly to manufacture. When the containers to be banded are moved by a conveyor at high speed and are slowed for banding purposes by a feed screw with a dwell time, they tend to jiggle. This often causes the bands to fall off, instead of landing directly over the containers. Moreover, containers with lips or other protrusions will also prevent the plastic sleeves from falling directly over the containers. The higher the speed at which the containers are moved past the stationery banding station, the greater the likelihood that the bands will not fall squarely over the containers, causing the containers to be improperly sealed.

OBJECTS OF THE INVENTION

It is therefore an object of the present invention to provide banding apparatus that is capable of high speed operation, using relatively short bands of heat-shrinkable plastic film, and of placing such bands over the containers or articles to be banded in a dependable and accurate manner.

It is another object of this invention to provide apparatus that is capable of banding articles without having to stop the articles on a conveyor while they are being banded, i.e. to provide banding to continuously moving articles on a conveyor line.

SUMMARY OF THE INVENTION

The above and other objects, which will be apparent to those skilled in the art, are achieved by the present invention, which comprises:

apparatus for rapidly and accurately placing bands of heat-shrinkable plastic film over articles to be banded, comprising in combination:

(a) means for transferring open bands of heat-shrinkable plastic film to, (b) means for holding said open bands and positioning them for pickup by said articles, said means being "C" shaped and tiltably mounted at the closed end thereof so as to be capable of being moved from a horizontal band pickup position to a downwardly inclined band discharge position, whereby the band, held loosely within said means when in the inclined band discharge position relative to the article to be banded, will be caused to slide over the article upon contact of the lower portion of said band by the moving article, (c) means for rotating said "C" shaped band positioning means in timed sequence with the articles to be banded from a horizontal position to a downwardly inclined position, and then back to the horizontal position again, (d) means for preventing the bands from being pushed back and out of proper banding position within said "C" shaped positioning means when coming in contact with the moving articles to be banded, and (e) means for conveying the articles to the banding position and from there to means for heat-shrinking the bands to fit tightly around the banded article.

The preferred means for preventing the band from being pushed back and out of proper banding position on coming in contact with the article or container to be banded is a pin located across and adjacent to the open mouth of the "C" shaped band positioner. The pin is mounted so as to rotate downward with the band positioner, but to stop sooner, thereby forming an impediment against rearward motion of the cylindrical band.

As used throughout the present specification and claims, the term article is used to mean one or more articles to be banded separately or together, as well as a container, such as a bottle, jar, can, etc. to be banded or sealed.

THE DRAWINGS

DETAILED DESCRIPTION

Figure 1:
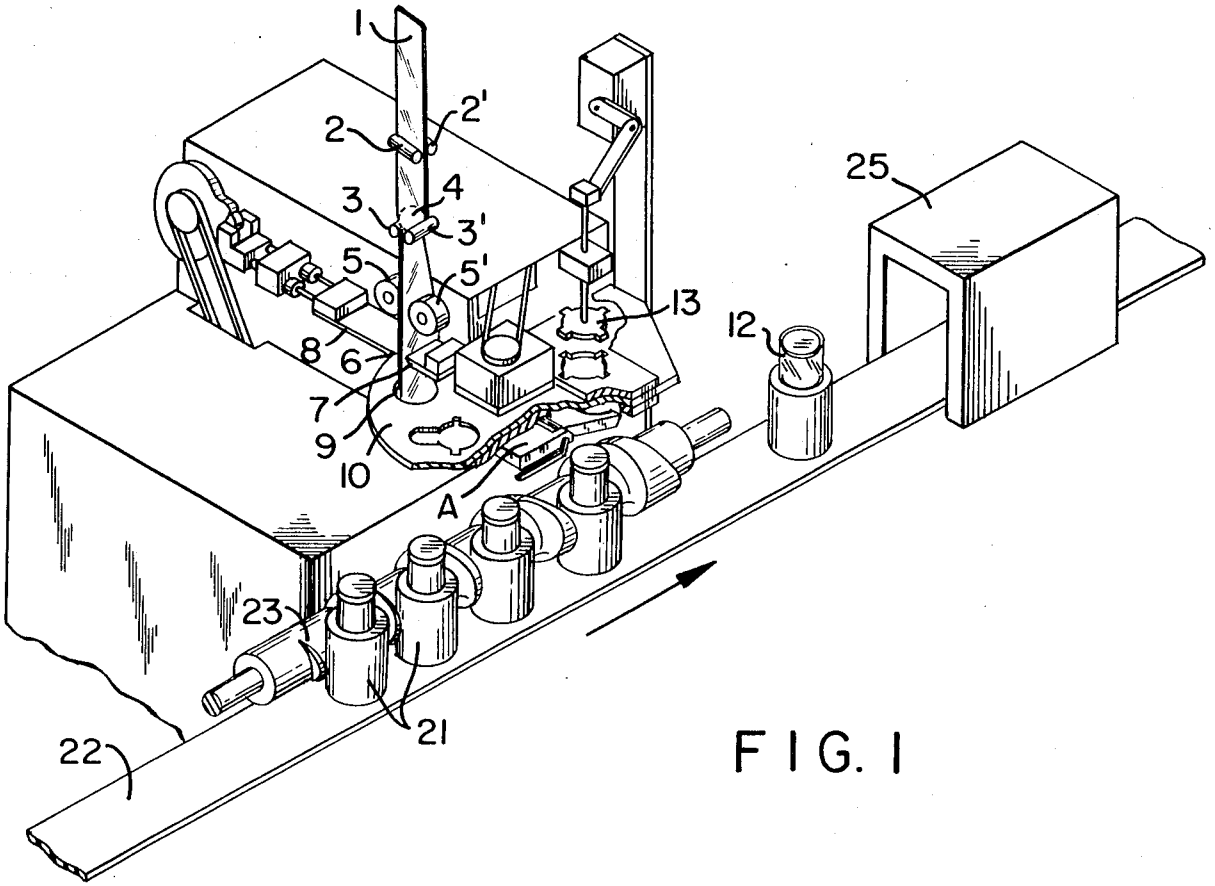
FIG. 1 is a perspective view, partially sectioned, illustrating the preferred embodiment of the present invention.

In order to gain a better understanding of the present invention reference is made to the drawings. FIG. 1 illustrates a banding machine made in accordance with the present invention. Flattened PVC or other plastic heat-shrinkable tubing 1, which is conventionally dispensed from a coil such as shown, for example, in my U.S. Pat. No. 3,924,387, is threaded through a pair of parallel guide rollers 2 and 2', and then through a tube opening device consisting of a pair of parallel rollers 3 and 3' mounted such that their axes are perpendicular to the axes of rollers 2 and 2'. A ball 4 or a triangular wedge placed inside tubing 1 rests on rollers 3 and 3'. As the tubing 1 passes through rollers 3 and 3', it is opened by ball 4 and then reflattened by parallel driven rollers 5 and 5' to be in the plane perpendicular to the plane in which it lay originally. Rollers 5 and 5' which are narrower in width than the reflattened tubing so as not to cause a second permanent crimp to be made in the edges of the reflattened tubing 1. Rollers 5 and 5' feed the reflattened tubing through cutting slit 6 formed by driven knife edge blade 7 and a stationary mating blade 8. The tubing 1 is next threaded through slot 9 in rotating plate 10 until the front edge of the tubing is just short of contacting the stationary plate 11 under rotating plate 10 (See FIG. 2). Tubing 1 is severed by blades 7 and 8 into a band 12 which springs open inside of slot 9, resting on plate 11. Rotation of plate 10 causes band 12 to be moved into alignment with the banding station consisting of plunger 13, band shaping stops 14 and 14', and the tilting mechanism A.

Figure 2:
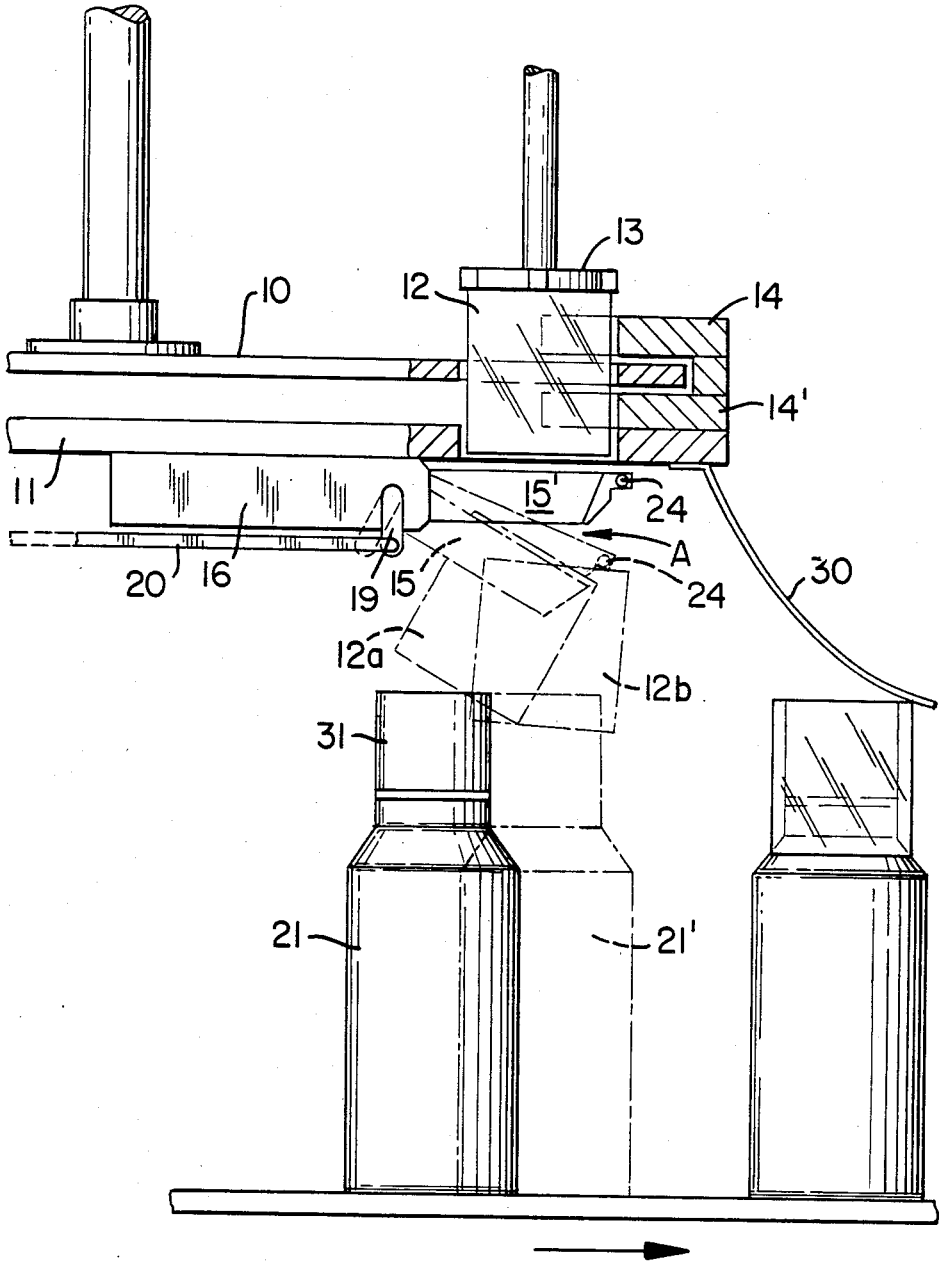
FIG. 2 is an enlarged front view of the embodiment shown in FIG. 1, wherein the band positioning means and the pin means for preventing the band from being pushed back are shown in greater detail.
Figure 3:
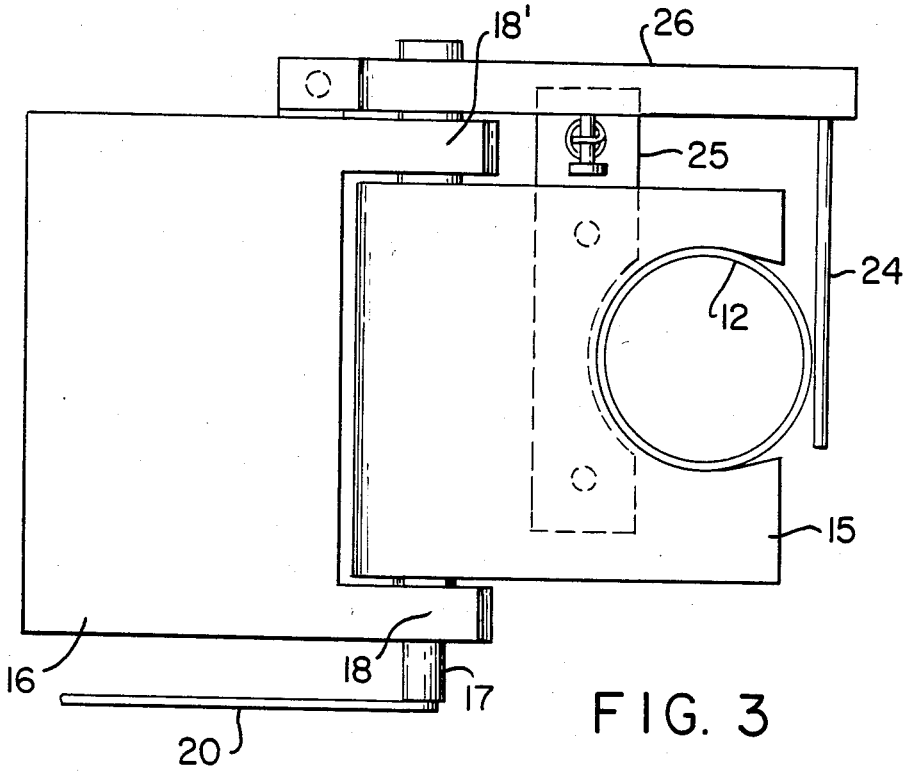
FIGS. 3, 4 and 5 are respectively enlarged top, front and rear views of the embodiment shown in FIG. 2, illustrating the structure and operation of the present invention.
Figure 4:
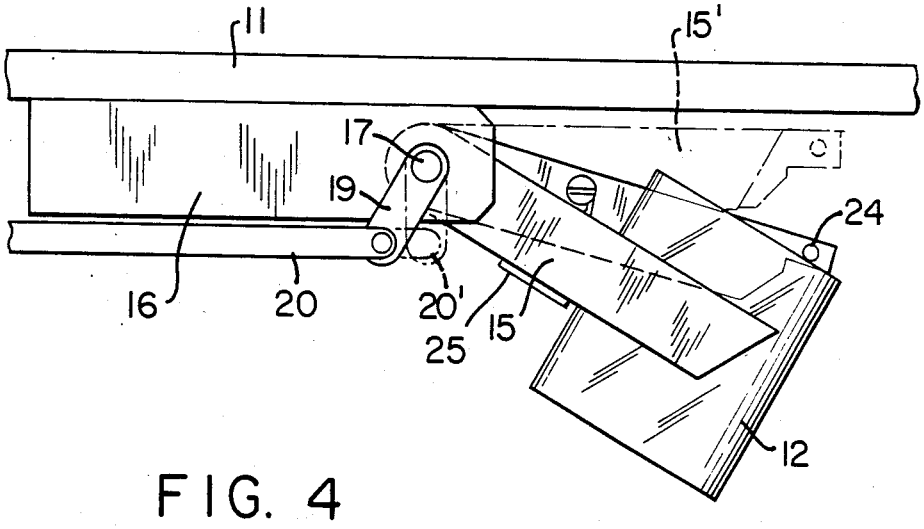

Tilting mechanism A, shown in detail in FIGS. 2—5 is comprised of a "C" shaped arm 15 which is tiltably attached at its closed back end to plate 16 by means of keyed pin 17. The ends of pin 17 are free to rotate in the drilled holes which extend through the extended portions 18 and 18' of plate 16. Mechanical linkage arms 19 and 20 which move from left (position 20) to right (position 20') in FIG. 4 are used to drive arm 15 between its horizontal position shown at 15' and its downwardly tilted position 15. Plate 16 is fixedly attached, for example, by bolts or screws (not shown) to plate 11.

The apparatus described above operates in the following manner. A plurality of articles to be banded, such bottles 21 are placed on a continuously driven belt conveyor 22. As the bottles approach the banding station, they are engaged by a driven screw conveyor 23 which serves to place each successive bottle directly at the spot where it contacts the lower inner edge of band **12*a* when the band is held in the inclined position by the "C" shaped arm 15. The open end of arm 15 makes it easy for the bottle to pick up the band from arm 15 as the bottle goes by, without any need for the bottle to stop or even slow down as it picks up the band which is forced by the tilting mechanism over the neck of the bottle as shown in FIG. 2. A flexible metal or plastic strip 30 serves to insure that the band 12 is forced down over the neck 31 of bottle 21, as far as it will go. After the band has been placed over the neck 31 of each bottle 21 conveyor belt 21 will move it through the heating tunnel 25 in which band 12** is shrunk tightly around the neck of the bottle.

The precise manner in which bands 12 are cut from the tubing 1 and transported to banding station is described in detail in my U.S. Pat. No. 3,924,387 and consequently requires no repetition here. The open band 12 as shown in FIG. 2 is pushed down by driven plunger 13 into the circular cavity of "C" shaped arm 15 until the top of the band is located slightly above the top edge of arm 15' when in the horizontal position. The size of the cavity in arm 15 is such as to hold band 12 loosely within its grasp. The cavity is more closed than semi-circular as shown in FIG. 3 to prevent the band from sliding out by itself. In synchonized timed sequence with the screw conveyor 23, arm 15 is caused to tilt down at about a 30° to 45° angle from the horizontal, carrying the band **12*a* with it and thereby positioning it for pick up by the passing bottle 21. After pickup of the band, linkage arm 20 is caused to be moved by a cam or other convenient driven means (not shown) to the right 20 (in FIGS. 2 and 4) causing arm 15 to be returned to the horizontal position 15'**, after which the cycle is repeated.

Throughout this description drive means are not shown, since any conventional drive means, such as electrical, mechanical or pneumatic drive means, may be used to drive the various moving elements of the apparatus in timed sequence.

Figure 5:
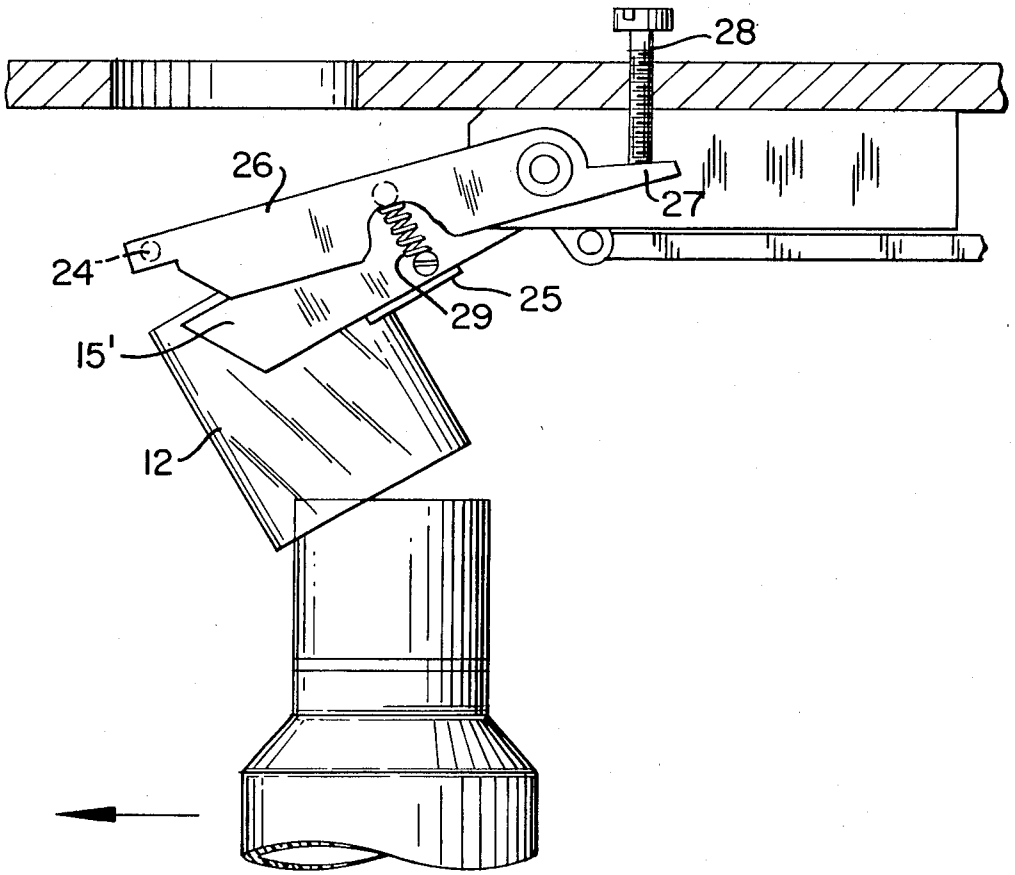

During rapid operation of the apparatus, it was discovered that when the bottles contacted the bands, the momentum of the bottle tended to push the bands back up through the cavity in arm 15 instead of picking them up as intended. To overcome this problem, the present invention is provided with means for preventing the bands from being pushed back within the "C" shaped positioning arm 15 when coming in contact with the moving bottles or other articles to be banded. Such means comprise a pin 24 or other suitable obstruction means which is located across and adjacent to the open mouth of "C" shaped arm 15 as shown best in FIG. 3. Pin 24 when in the retracted, horizontal position is out of the way so as not to interfere with the ability of the band 12 to be pushed by plunger 13 into the cavity of arm 15. As shown in FIG. 5, pin 24 is fixedly attached at one end to pivoting arm 26. The back end of arm 26 is pivotally attached to rotating shaft 17 and attached via a spring 29 to arm 15 so that when arm 15 is rotated downwardly, arm 26 is simultaneously rotated also as is pin 24. However, arm 26 is provided with an extended portion 27, the top surface of which will contact stopping bolt 28, causing the pin 24 to stop its downward rotation while arm 15 continues to be rotated further downward. By stopping its rotation sooner, pin 24 ends up above band 12 and inside the upward cylindrical extension of the band. Consequently, the band cannot be pushed back up through the cavity of arm 15 because pin 24 will block and therefore prevent its backward movement. When this happens, the forward motion imparted to band **12*a* (See FIG. 2.) by the neck 31 of the bottle 21 will cause the band to rotate or pivot about pin 24 into the position shown as 12*b* at which time the bottle will have moved to position shown as 21'. Thus the function of pin 24 is to both stop the band from being pushed out of proper banding position and to insure that the band is forced over the bottle. When arm 15 is moved back to its horizontal position, it will, as a result of the spring connection 29, carry arm 26 back with it also. Plate 25 which is bolted to the bottom surface of arm 15 prevents arm 26 from moving past allignment with arm 15**.

I claim:

1. Apparatus for rapidly and accurately placing bands of heat-shrinkable plastic film over articles to be banded, comprising in combination:

(a) means for transferring open bands of heat-shrinkable plastic film, (b) means for holding said open bands received from said means for transferring and for positioning them for pickup by said articles, said means comprising a "C" shaped arm having an open front-end and a closed back-end, and being tiltably mounted at the back-end, so as to be capable of being moved from a horizontal band pickup position to a downwardly inclined band discharge position, whereby the band, held loosely within said means when in the inclined band discharge position relative to the article to be banded, will be caused to slide over the article upon contact of the lower portion of said band by the moving article, (c) means for rotating said "C" shaped band positioning means in timed sequence with the articles to be banded from a horizontal position to a downwardly inclined banding position, and then back to the horizontal position again, (d) means for preventing the bands from being pushed back and out of proper banding position within said "C" shaped positioning means after coming in contact with the moving articles to be banded, said preventing means comprising: (1) a mechanical obstruction across the top of said "C" shaped arm, and (2) means for independent movement with respect to said "C" shaped arm, and (e) means for conveying the articles to the banding position and from there to means for heat-shrinking bands to fit tightly around the banded article.

2. The apparatus of claim 1, wherein the means for preventing the band from being pushed back and out of proper banding position on coming in contact with the article to be banded comprises a pin located across and adjacent to the open front end of the "C" shaped band positioning means, said pin being mounted so as to rotate downwardly together with the band positioning means, but stopped sooner than said band positioning means, whereby said pin forms an impediment against rearward motion of the cylindrical band held within said "C" shaped band positioning means.

* * * * *